US006210187B1

(12) United States Patent
Tung

(10) Patent No.: US 6,210,187 B1
(45) Date of Patent: Apr. 3, 2001

(54) CARD CONNECTOR WITH REINFORCED CARD EJECTING PLATE

(75) Inventor: Shun-Chi Tung, Taipei Hsien (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/218,747

(22) Filed: Dec. 22, 1998

(30) Foreign Application Priority Data

Dec. 31, 1997 (TW) ..... 86221852

(51) Int. Cl.[7] ..... H01R 13/62
(52) U.S. Cl. ..... 439/159
(58) Field of Search ..... 439/159, 160, 439/152, 157; 361/754

(56) References Cited

U.S. PATENT DOCUMENTS 5,451,168 * 9/1995 Shuey ..... 439/159
5,707,259 * 1/1998 Ishizuka et al. ..... 439/852
5,730,610 * 3/1998 Hsia et al. ..... 439/160
5,836,775 * 11/1998 Hiyama et al. ..... 439/159

* cited by examiner

*Primary Examiner*—Khiem Nguyen
*Assistant Examiner*—Son Y. Nguyen

(57) ABSTRACT

A card connector has a header connector, a shielding mounted on the header connector and forming an arced guiding section and a rectangular guiding section, a push rod reciprocably mounted on the shielding for receiving a push force, a lever pivotably mounted on the shielding and having a first end drivably connected with the push rod and a second end slidably engaging with the arced guiding section and an elongate card ejecting plate including a middle tab drivably connected with the lever, a guiding tab slidably engaging with the rectangular guiding section, two card engaging tabs for exerting a card ejecting force to a card inserted into the connector, and two supporting tabs located respectively behind the card engaging tabs which supportively abut the corresponding card engaging tabs when the card ejecting plate is driven to eject an inserted card, thereby preventing excessive deformation from occurring to the card engaging tabs due to the card ejecting force.

17 Claims, 8 Drawing Sheets

CARD CONNECTOR WITH REINFORCED CARD EJECTING PLATE

BACKGROUND OF THE INVENTION

1. Field of The Invention

The present invention relates to a card connector, and particularly to a card ejecting mechanism of a card connector.

2. The Prior Art

Following the development of computer technology, a variety of cards, such as PCMCIA cards and memory cards, have been developed to meet different requirements, and a variety of card connectors have been developed to connect the cards to respective mother boards. Taiwan Patent Application Nos. 84210016, 85208532 and U.S. Pat No. 5,456,610 disclose such connectors. Each connector is equipped with an ejector mechanism having a card ejecting plate with at least a card engaging tab for engaging with an inserted card. When the ejector mechanism is activated to eject the inserted card, the card engaging tab exerts a push force on the card.

The card engaging tabs disclosed in Taiwan Patent Application Nos. 84210016 and 85208532 extend in a direction parallel to an engaged side of the inserted card whereby a uniform ejecting force can be exerted on the card. However, due to the requirement of miniaturization of the card connector, the card ejecting plate becomes thinner and thinner. A card engaging tab arranged in this manner is not rigid enough to sustain the ejecting force and will deform excessively during ejection of the inserted card. When this happens, the card engaging tab can no longer properly perform its intended function.

U.S. Pat No. 5,456,610 discloses a card engaging tab extending in a direction perpendicular to an engaged side of the inserted card, whereby the engaging tab has an increased rigidity. However, in this arrangement, the contact area between the engaging tab and the card is relatively small causing a large amount of stress to be exerted on the card when the card is rejected. Thus, the card cannot be smoothly ejected out of the connector.

Furthermore, none of the prior art card connectors has a card ejecting mechanism which can be positively guided during operation to have a stable and reliable movement to eject the inserted card.

Hence, an improved connector is needed to eliminate the above mentioned defects of current card connectors.

SUMMARY OF THE INVENTION

Accordingly, an objective of the present invention is to provide a card connector having a card ejecting mechanism with an improved card ejecting plate which can smoothly eject an inserted card while card engaging tabs thereof will not be excessively deformed.

A further objective of the present invention is to provide a card connector having guiding means which can guide the card ejecting mechanism to have a stable and reliable movement to eject an electronic card inserted into the connector.

To fulfill the above mentioned objectives, according to one embodiment of the present invention, a card connector consists of a header connector with pins each having a contact portion at a front side thereof for engaging with an inserted card and a tail portion at a rear side thereof for being soldered to a printed circuit board. A metallic shielding has a head portion fixedly attached to the header connector and a pair of card guiding rails extending in front of the header connector. A card ejecting mechanism is drivably mounted on the shielding. The card ejecting mechanism includes a push rod reciprocably mounted on a rail of the shielding. A lever is pivotably mounted on the head portion of the shielding and has a first end engaging with the push rod and an opposed second end slidably engaging with an arced section formed by the head portion of the shielding. An elongate card ejecting plate is linearly and movably mounted on the shielding, and has a middle tab engaging with the lever near the second end thereof and two card engaging tabs at two lateral ends thereof for exerting an ejecting force on an inserted card. Each card engaging tab extends parallel to a longitudinal direction of the card ejecting plate to evenly exert an ejecting force on the card for smooth ejection. The card ejecting plate further forms two supporting tabs located immediately behind the card engaging tabs, respectively, which supportively abut the corresponding card engaging tabs when the card is ejected, thereby preventing an excessive deformation of the card engaging tabs due to the ejecting force.

DETAILED DESCRIPTION OF THE PREFERRED EMBODIMENTS

Figure 1:
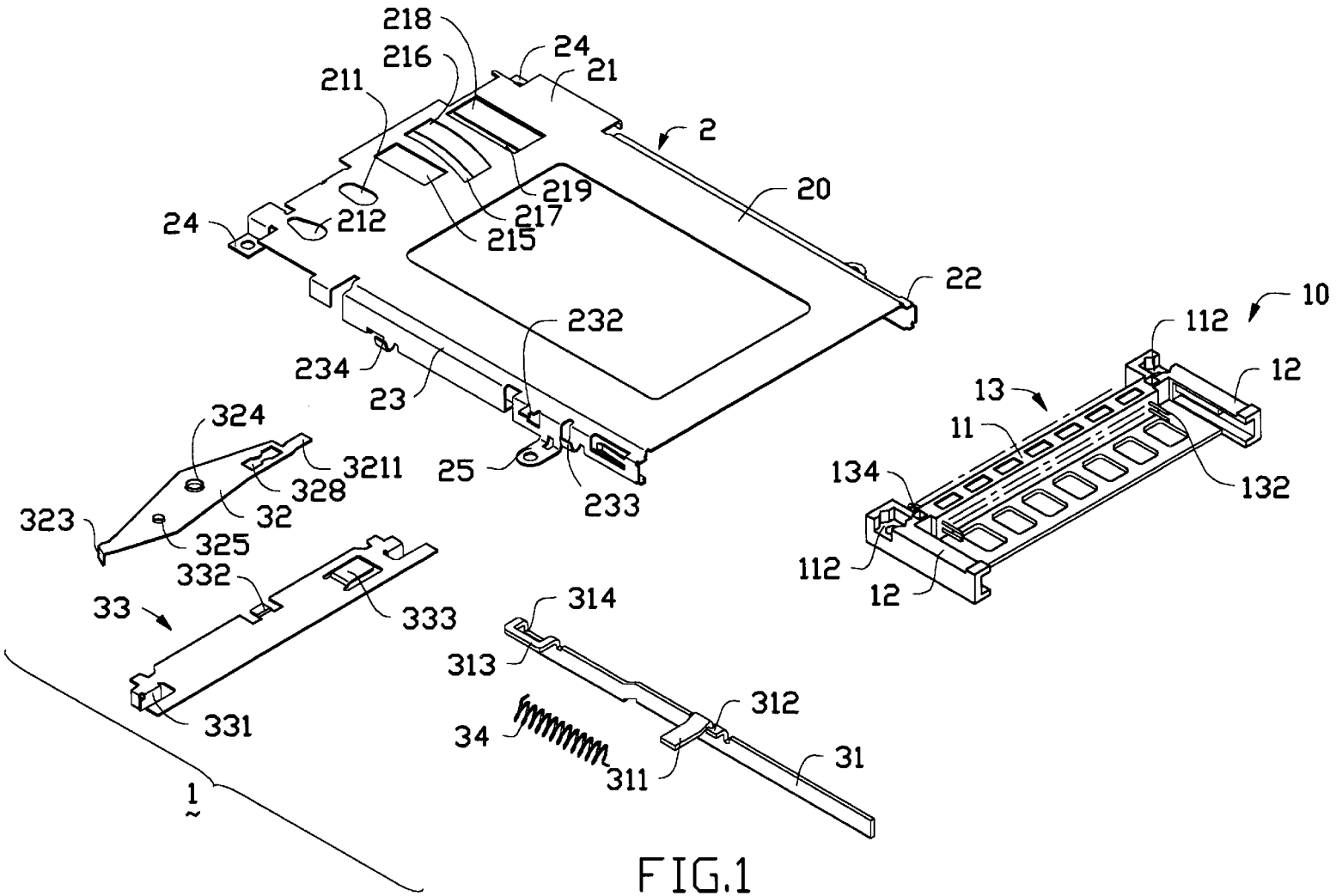
FIG. 1 is an exploded, perspective view of a card connector in accordance with a first embodiment of the present invention.

Reference will now be made in detail to the preferred embodiments of the present invention.

Referring to FIGS. 1 to 3A, a card connector 1 in accordance with a first embodiment of the present invention includes a header connector 10 having an elongate dielectric housing 11 fixedly receiving a number of conductive contacts 13 therein. Each contact 13 has a contact portion 132 at a front side of the housing 11 for engaging with an electronic card (not shown) inserted into the connector 1 and a tail portion 134 for being soldered to a printed circuit board (PCB, not shown). Two hexagonal depressions 112 are defined in two lateral ends of the housing 11 by which nuts and screws (not shown) can be used to fix the connector 1 to the PCB. Two guiding arms 12 extend forward from the two lateral ends of the housing 11 for guiding the card into/away from the header connector 10.

A metallic shielding 2 is formed by stamping a metal sheet to have a body portion 20 in front of the header connector 10 and a head portion 21 mounted on the header connector 10. The body portion 20 forms first and second guiding rails 22, 23 at two lateral sides thereof for guiding the card into/away from the card connector 1. Two mounting legs 25 are integrally formed with the guiding rails 22, 23, respectively, and extend downward therefrom for extension of two screws (not shown) therethrough for fixing the shielding 2 to the PCB. The second rail 23 is additionally formed with a projection 232 defining a cut 235 and two brackets 233, 234.

The head portion 21 of the shielding 2 forms two mounting ears 24 at two lateral ends thereof for being fixedly received in the depressions 112 of the housing 11 of the card connector 10. A rectangular hole 215 is defined in a middle of the head portion 21. An arced slit 217 is defined in the head portion 21 to the right of the rectangular hole 215. An arced guiding plate 216 is formed by depressing the head portion 21 immediately beside the arced slit 217. The arced guiding plate 216 is at a level slightly lower than the head portion 21. An elongate slit 219 is defined in the head portion 21 to the right of the arced guiding plate 216, and a rectangular guiding plate 218 is formed by depressing the head portion 21 immediately beside the elongate slit 219. The rectangular guiding plate 218 is also at a level slightly lower than the head portion 21. Two pear-shaped holes 211, 212 are defined in the head portion 21 to the left of the rectangular hole 215.

An elongate push rod 31 is formed by stamping a metal sheet to have an engaging lug 313 at a rear end thereof, a handle 311 at a middle portion thereof for receiving a push force, and a projection 312 in front of the handle 311. The lug 313 defines a rectangular hole 314 and the projection 312 defines a cut 315. The handle 311 extends in a direction perpendicular to a longitudinal direction of the rod 31.

An elongate card ejecting plate 33 is formed by stamping a metal sheet to have a push force receiving tab 332 on a rear side of a middle portion thereof, a guiding tab 333 on a right side thereof pointing toward a right end, and two card engaging tabs 331 at two lateral ends thereof. The card engaging tabs 331 extend along a longitudinal direction of the card ejecting plate 33 for having a large engaging area with an electronic card inserted into the card connector 1; thus, the inserted card can be smoothly ejected out of the header connector 10 by the card ejecting plate 33.

Figure 3:
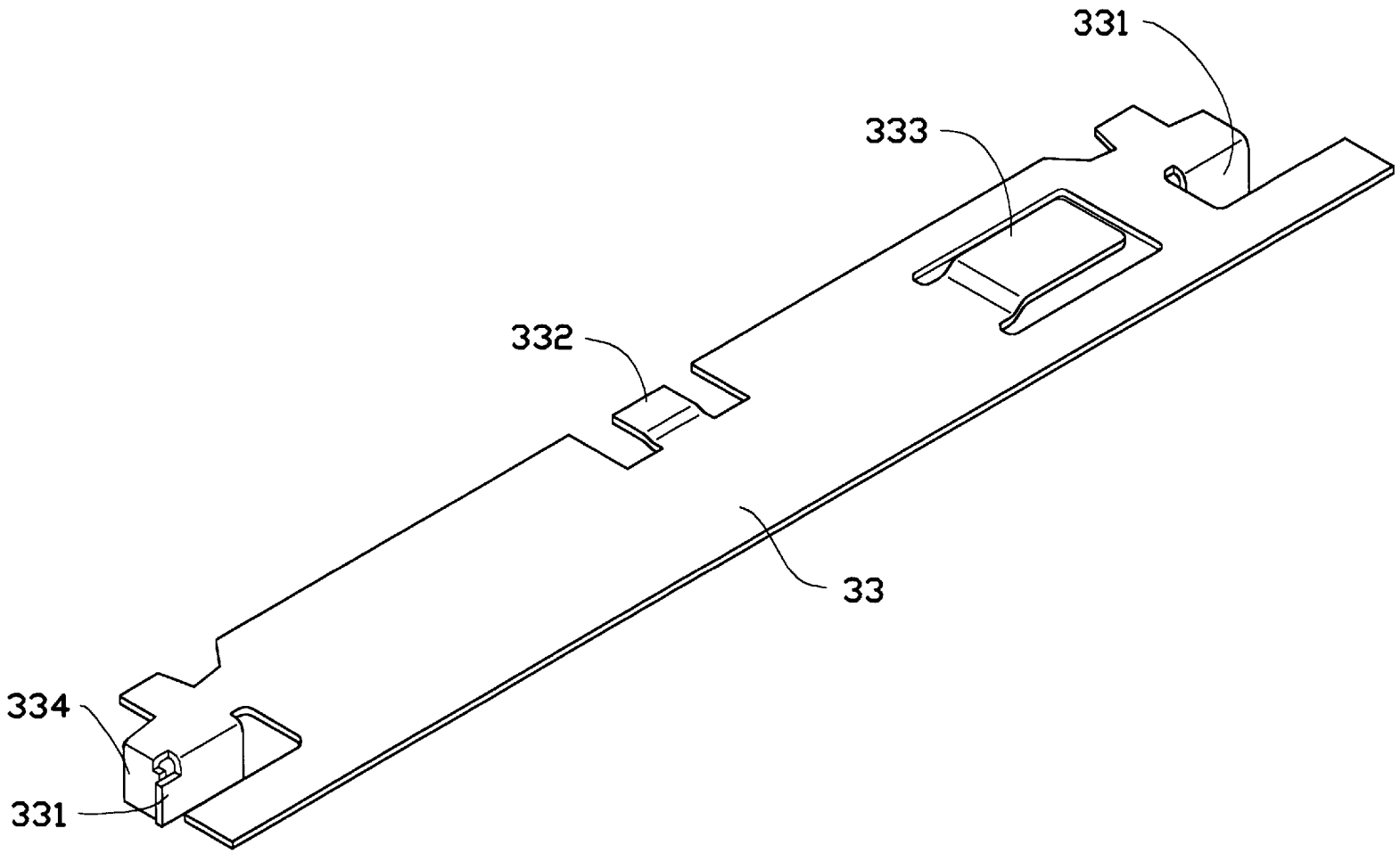
FIG. 3 is a perspective view of a card ejecting plate of the card connector of FIG. 1.
Figure 3A:
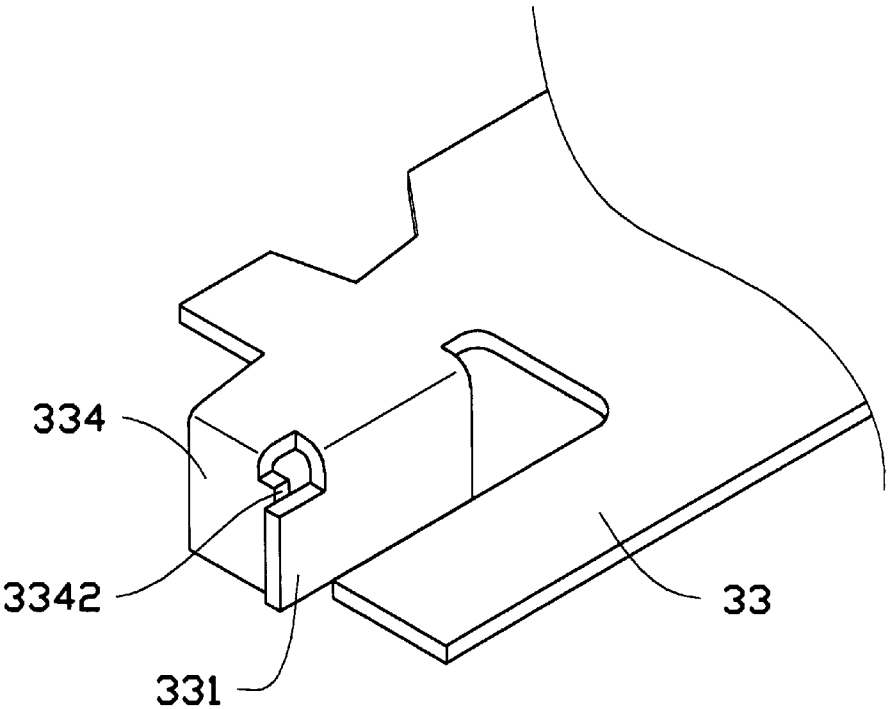
FIG. 3A is a partially enlarged view of the card ejecting plate of FIG. 3.

Particularly referring to FIGS. 3 and 3A, the card ejecting plate 33 is further formed with two supporting tabs 334 located behind the card engaging tabs 331. Each supporting tab 334 has a front edge 3342 which, when the card ejecting plate 33 is activated to eject an inserted card, supportively abuts the corresponding card engaging plate 331 thereby preventing excessive deformation from occurring thereto due to the card ejecting force. In this embodiment, both the supporting tabs 334 and card engaging tabs 331 are formed by bending the corresponding lateral sides of the card ejecting plate 33 downward, and the supporting tabs 334 are oriented to be perpendicular to the corresponding card engaging tabs 331.

Figure 4:
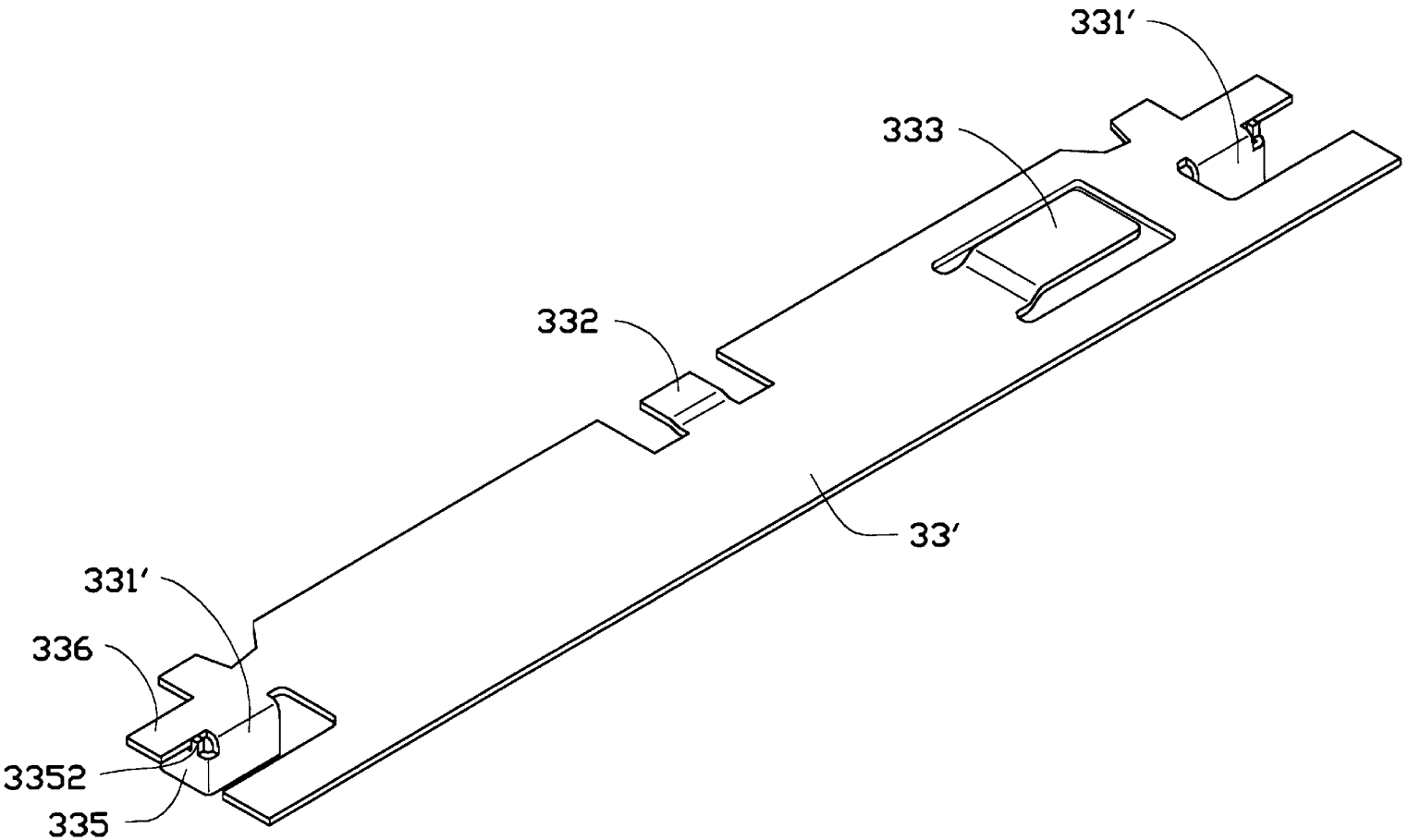
FIG. 4 is a perspective view of a card ejecting plate in accordance with a second embodiment of the present invention.
Figure 4A:
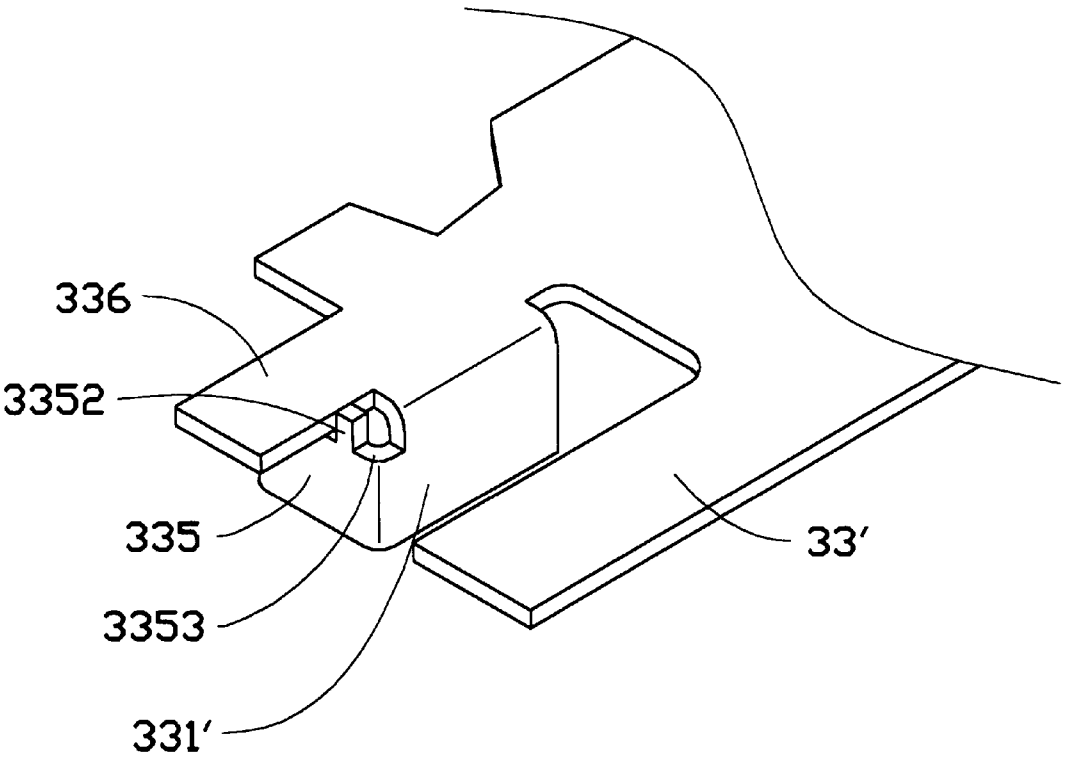
FIG. 4A is a partially enlarged view of the card ejecting plate of FIG. 4.

FIGS. 4 and 4A show a card ejecting plate 33' in accordance with a second embodiment of the present invention which has a push force receiving tab 332 and a guiding tab 333 identical to the first embodiment. However, in this embodiment, a card engaging tab 331' is integrally formed with a side wall 335 extending rearward from a lateral side of the corresponding card engaging tab 331'. The side wall 335 has an upper key 3352 protruding from a top edge 3353 thereof. Two supporting tabs 336 horizontally extend from two lateral ends of the card ejecting plate 33' behind the corresponding keys 3352. When the card ejecting plate 33' is activated to eject an inserted card, the 15 supporting tabs 336 supportively abut the keys 3352 to prevent excessive deformation of the card engaging tabs 331' due to the card ejecting force.

Figure 5:
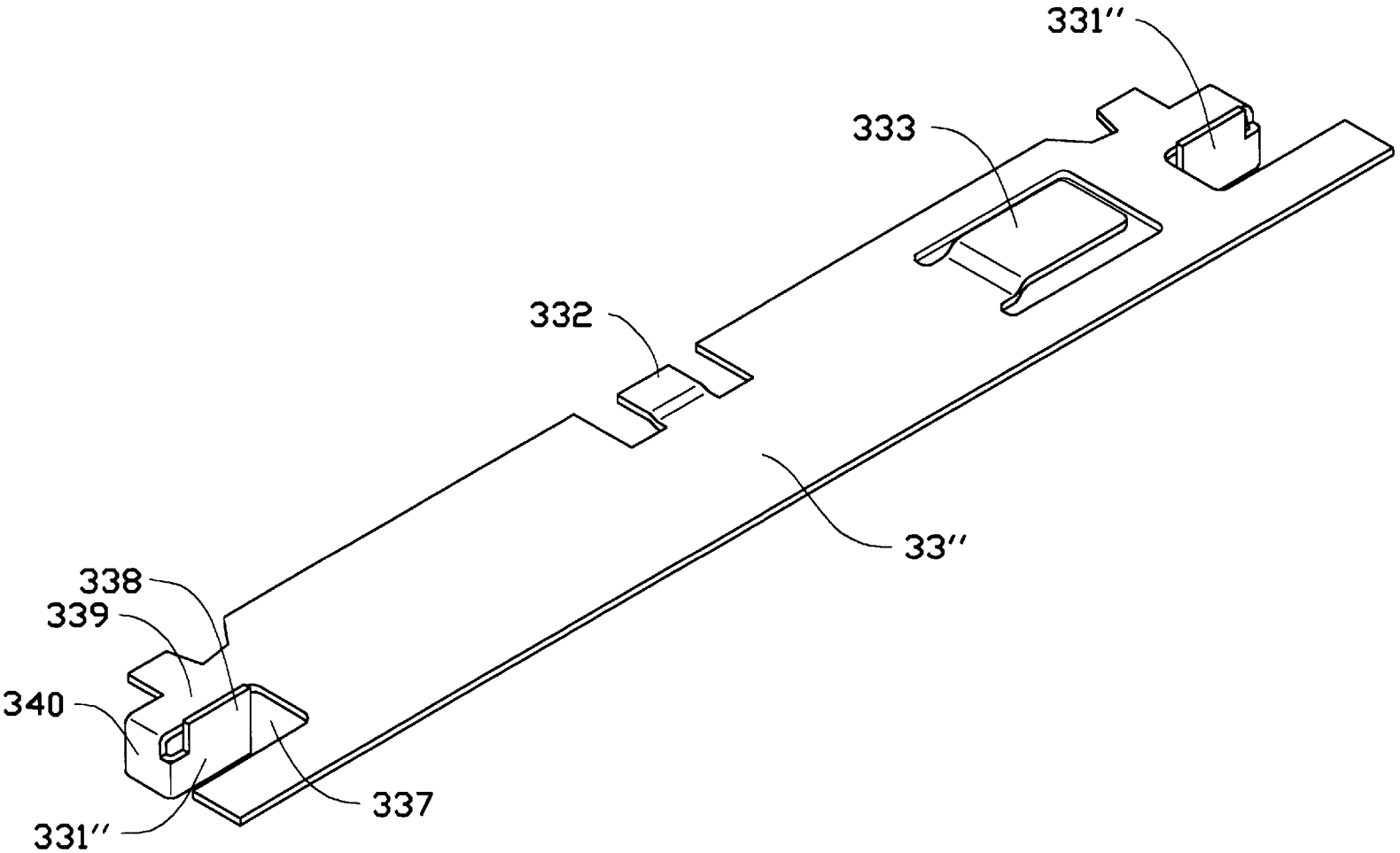
FIG. 5 is a perspective view of a card ejecting plate in accordance with a third embodiment of the present invention.
Figure 5A:
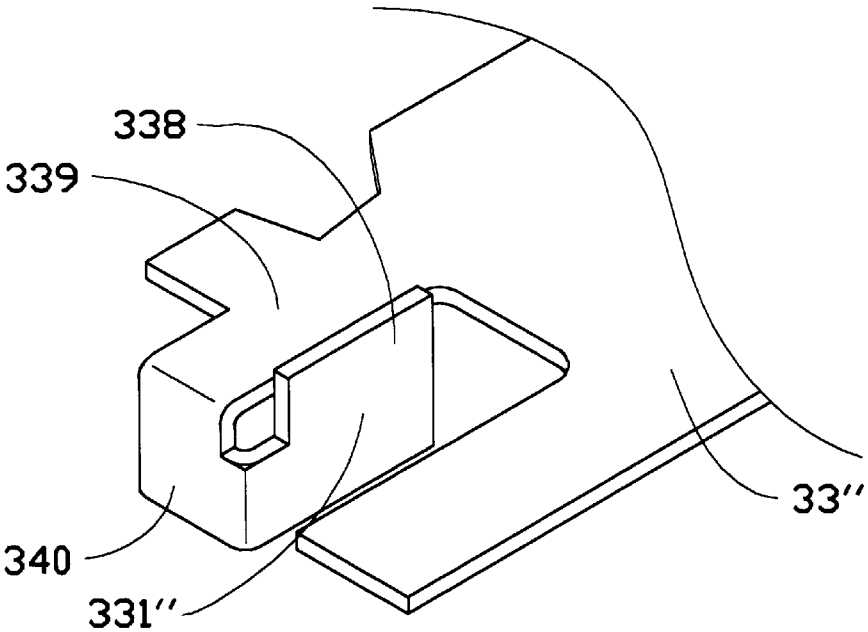
FIG. 5A is a partially enlarged view of the card ejecting plate of FIG. 5.

FIGS. 5 and 5A show a card ejecting plate 33" in accordance with a third embodiment of the present invention. The card ejecting plate 33" has a push force receiving tab 332 and a guiding tab 333 identical to the first embodiment. However, in this embodiment, the card ejecting plate 33" has card engaging tabs 331" formed by inwardly bending lateral ends of the card ejecting plate 33" into cavities 337 defined in the lateral ends of the plate 33". Each card engaging tab 331" is located in front of a horizontally extending supporting tab 339 and has an upper portion 338 extending upward therefrom. When the card engaging tabs 331" eject an inserted card, the supporting tabs 339 supportively abut the upper portion 338 of the card engaging tabs 331" to prevent excessive deformation from occurring thereto. Each card engaging tab 331" is connected with the corresponding supporting tab 339 via a flap 340 vertically extending downward from a lateral end of the corresponding supporting tab 339.

Details regarding how the inserted card is ejected from the header connector 10 by the card ejecting plates 33, 33', 33" are given below.

Referring back to FIGS. 1 and 2, a lever 32 is made by stamping a metal sheet to have a force receiving end 323 extending downward from a left end thereof. A guiding tab 3211 extends from a right end of the lever 32. A necked hole 328 is defined in the lever 32 near the guiding tab 3211. Two round protrusions 324, 325 project upward between the force receiving end 323 and the necked hole 328.

Figure 2:
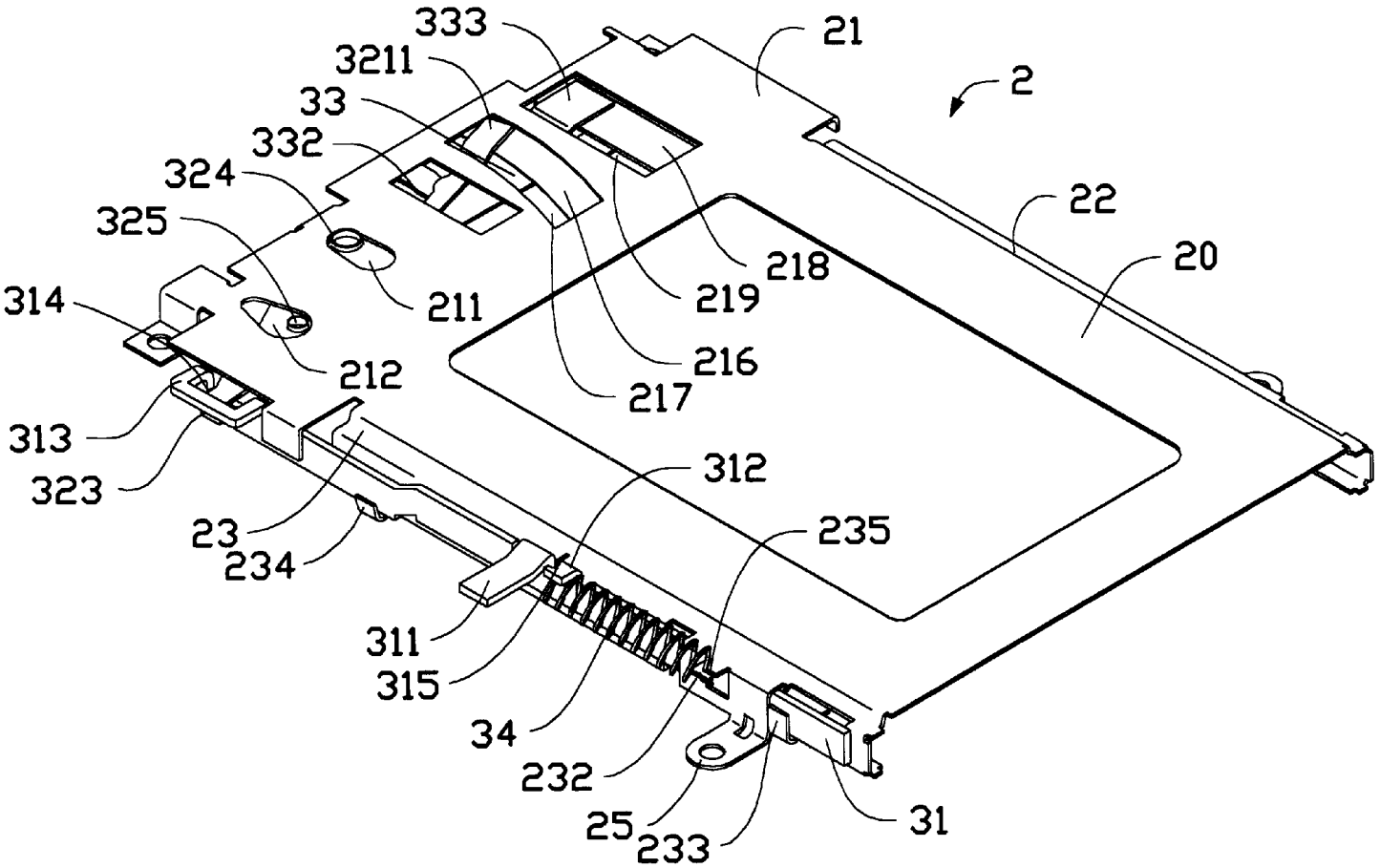
FIG. 2 is a perspective view of a combination of a shielding and a card ejecting mechanism of the card connector of FIG. 1.

To assemble the connector 1, the shielding 2, the lever 32, the card ejecting plate 33 and the push rod 31 are assembled together as shown in FIG. 2. The push rod 31 is reciprocably mounted on the brackets 233, 234 with the lug 313 being located below the head portion 21 of the shielding 2. A helical spring 34 has a front end fixedly received in the cut 235 in the projection 232 of the shielding 2 and a rear end fixedly received in the cut 315 in the projection 312 of the rod 31. When a push force exerted on the handle 311 to eject an inserted card is released, the spring 34, which has been extended by the push force, can automatically force the handle 31 together with the lever 32 and the card ejecting plate 33 to return to their original positions as shown in FIG. 2.

Thereafter, the lever 32 is mounted to the shielding 2 and the rod 31 by extending the force receiving end 323 into the hole 314 defined by the lug 313 of the rod 31 to drivably engage therewith. Two round protrusions 324, 325 are received in the corresponding pear-shaped holes 211, 212 of the shielding 2, and the guiding tab 3211 is inserted through the arced slit 217 to slidably engage with the arced guiding plate 216.

Afterward, the card ejecting plate 33 is mounted to the lever 32 and the shielding 2 by extending the force receiving tab 332 into the necked hole 328 of the lever 32 and the guiding tab 333 through the elongate silt 219 to slidably engage with the rectangular guiding plate 218.

Finally, the above subassembly is mounted to the header connector 10 and assembled therewith to a printed circuit board (not shown) in a manner known by those skilled in the art which is irrelevant to the inventive features of the present invention, thus, detailed descriptions thereof are omitted herein.

When the push rod 31 is pushed toward the head portion 21 of the shielding 2 from the position shown in FIG. 2, the push force causes the lever 32 to pivot while the guiding tab 3211 moves forward along the arced guiding plate 216. The pivoting movement of the lever 32 pushes the force receiving tab 322 to cause the card ejecting plate 33 to move forward thereby ejecting the inserted card away from the header connector 10. During the forward movement of the card ejecting plate 33, the guiding tab 333 moves along the rectangular guiding plate 218. By cooperation between the guiding tab 3211 and the arced guiding plate 216, and between the guiding tab 333 and the rectangular guiding plate 218, the lever 32 and the card ejecting plate 33 can stably and reliably eject an inserted card.

The card ejecting plate 33 can be replaced by either of the card ejecting plates 33', 33", since the only difference concerns the configuration of the card engaging tabs and supporting tabs. When the card ejecting plate 33 is replaced by the plate 33' or 33" and the push rod 31 is pushed toward the head portion 21 of the shielding 2, the card ejecting plate 33', 33" ejects the inserted card by its card engaging tabs 331', 331" in a manner similar to the card ejecting plate 33.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

I claim:

1. A card connector for connecting an electronic card to a mother board, comprising:

a header connector having a front face for engaging with the electronic card inserted into the card connector and a rear face opposite the front face;

a metallic shielding mounted on the header connector and having guiding rails extending in front of the header connector for guiding the electronic card to move into/out of the card connector; and ejector means movably mounted on the metallic shielding for receiving an external force to eject the electronic card inserted into the card connector and engaged with the header connector, said ejector means comprising an elongate card ejecting plate having a card engaging tab extending parallel to a longitudinal direction of the card ejecting plate and a supporting tab located behind the card engaging tab, said supporting tab supportively abutting the card engaging tab when the ejector means is driven to eject the electronic card inserted into the card connector.

2. The card connector in accordance with claim 1, wherein the supporting tab extends in a direction perpendicular to the longitudinal direction of the card ejecting plate.

3. The card connector in accordance with claim 1, wherein the card engaging tab has a side wall with an upper key and the supporting tab abuts the upper key instead of the card engaging tab when the ejector means is driven to eject the electronic card inserted into the card connector.

4. The card connector in accordance with claim 1, wherein the supporting tab supportively abuts an upper portion of the card engaging tab when the ejector means is driven to eject the electronic card inserted into the card connector.

5. A card connector for connecting an electronic card to a printed circuit board, having:

a header connector having a housing fixedly receiving a number of contacts with contact portions for engaging with the electronic card inserted into the card connector and tail portions for being soldered to the printed circuit board;

a metallic shielding having a head portion mounted on the header connector and two guiding rails for guiding the electronic card into/out of the card connector, the head portion forming an arced guiding section and a rectangular guiding section;

a push rod reciprocatably mounted on one of the guiding rails for receiving an external push force;

a lever pivotally mounted on the metallic shielding, having a first end drivably engaged with the push rod and a second end slidably engaged with the arced guiding section; and a card ejecting plate having a force receiving tab located at a middle thereof and drivably engaging with the lever and a guiding tab slidably engaged with the rectangular guiding section.

6. The card connector in accordance with claim 5, wherein the push rod has a handle for receiving a push force, said handle extending in a direction perpendicular to the reciprocating direction of the push rod.

7. The card connector in accordance with claim 5 further comprising a spring having a first end fixed to the push rod and a second end fixed to the metallic shielding.

8. The card connector in accordance with claim 5, wherein the second end of the lever extends through an arced slit defined in the metallic shielding to slidably engage with the arced guiding section, and the guiding tab of the card ejecting plate extends through an elongate slit defined in the metallic shielding to slidably engage with the rectangular guiding section.

9. The card connector in accordance with claim 5, wherein the rectangular guiding section is located further away from a middle of the card ejecting plate than the arced guiding section.

10. A card connector for connecting an electronic card to a printed circuit board, having:

a header connector having a housing fixedly receiving a number of contacts with contact portions for engaging with the electronic card inserted into the card connector and tail portions for being soldered to the printed circuit board;

a metallic shielding having a head portion mounted on the header connector and two guiding rails for guiding the electronic card into/out of the card connector, the head portion forming an arced guiding section and a rectangular guiding section; and an ejector mechanism drivably mounted on the metallic shielding for ejecting the electronic card inserted into the card connector, comprising:

a push rod reciprocatably mounted on the metallic shielding;

a lever pivotally mounted on the metallic shielding, having a first end drivably engaged with the push rod and a second end slidably engaged with the arced guiding section; and an elongate card ejecting plate having a force receiving tab drivably engaging with the lever, a guiding tab slidably engaging with the rectangular guiding section, a card engaging tab for engaging with the electronic card inserted into the card connector, and a supporting tab supportively abutting the card engaging tab to prevent excessive deformation from occurring to the card engaging tab when the ejector mechanism is driven to eject the electronic card inserted into the card connector.

11. The card connector in accordance with claim 10, wherein the supporting tab extends in a direction perpendicular to a longitudinal direction of the card ejecting plate.

12. The card connector in accordance with claim 10, wherein the card engaging tab has a side wall with an upper key, the supporting tab abutting the upper key when the ejector mechanism is driven to eject the electronic card inserted into the card connector.

13. The card connector in accordance with claim 10, wherein the supporting tab supportively abuts an upper portion of the card engaging tab when the ejector mechanism is driven to eject the electronic card inserted into the card connector.

14. The card connector in accordance with claim 10, wherein the push rod has a handle for receiving a push force, said handle extending in a direction perpendicular to the reciprocating direction of the push rod.

15. The card connector in accordance with claim 10 further comprising a spring having a first end fixed to the push rod and a second end fixed to the metallic shielding.

16. The card connector in accordance with claim 10, wherein the second end of the lever extends through an arced slit defined in the metallic shielding to slidably engage with the arced guiding section, and the guiding tab of the card ejecting plate extends through an elongate slit defined in the metallic shielding to slidably engage with the rectangular guiding section.

17. The card connector in accordance with claim 10, wherein the rectangular guiding section is located further away from a middle of the card ejecting plate than the arced guiding section.

* * * * *